US010945058B2

(12) United States Patent
Liu et al.

(10) Patent No.: US 10,945,058 B2
(45) Date of Patent: Mar. 9, 2021

(54) BALANCED STEREO HEADPHONES WITH UN-BALANCED AIR CHAMBERS

(71) Applicant: SYNAPTICS INCORPORATED, San Jose, CA (US)

(72) Inventors: Wensen Liu, Irvine, CA (US); Govind Kannan, Irvine, CA (US)

(73) Assignee: SYNAPTICS INCORPORATED, San Jose, CA (US)

( * ) Notice: Subject to any disclaimer, the term of this patent is extended or adjusted under 35 U.S.C. 154(b) by 0 days.

(21) Appl. No.: 16/455,617

(22) Filed: Jun. 27, 2019

(65) Prior Publication Data

US 2020/0413170 A1 Dec. 31, 2020

(51) Int. Cl.

| | |
|---|---|
| ***H04R 1/02*** | (2006.01) |
| ***H04R 1/28*** | (2006.01) |
| ***H04R 1/10*** | (2006.01) |

(52) U.S. Cl.

CPC ..... *H04R 1/02* (2013.01); *H04R 1/1008* (2013.01); *H04R 1/1075* (2013.01); *H04R 1/2803* (2013.01)

(58) Field of Classification Search

CPC ..... H04R 1/02; H04R 1/1008; H04R 1/1075; H04R 1/2803

See application file for complete search history.

(56) References Cited

U.S. PATENT DOCUMENTS

| | | | | |
|---|---|---|---|---|
| RE37,398 | E | 10/2001 | Nageno | |
| 6,817,440 | B1 * | 11/2004 | Kim | H04R 1/1075 181/128 |
| 7,466,838 | B1 * | 12/2008 | Moseley | G10K 11/178 381/370 |
| 8,625,833 | B1 | 1/2014 | Armwood | |
| 8,861,766 | B2 * | 10/2014 | Ouryouji | H04R 1/1058 381/370 |
| 9,208,769 | B2 * | 12/2015 | Azmi | G10K 11/17857 |
| 9,210,495 | B2 | 12/2015 | Akino | |
| 10,117,017 | B2 | 10/2018 | Kuwahara et al. | |
| 2017/0026739 | A1 | 1/2017 | Miwa et al. | |
| 2019/0191237 | A1 * | 6/2019 | Wang | G10K 11/17857 |

* cited by examiner

*Primary Examiner* — Brian Ensey

(74) *Attorney, Agent, or Firm* — Haynes and Boone, LLP

(57) ABSTRACT

Speaker performance may be improved by increasing the effective acoustic chamber volume by fluidically connecting a speaker chamber containing a speaker with a mechanical housing. Additionally, the performance of left and right speakers may be balanced. Such balancing may be through equalization of the left and right speakers, balancing the acoustic impedance through sizing the openings between the speaker chambers and mechanical housings, and/or balancing of acoustic volumes within the speakers through use of ballast or acoustic expansion material to increase or decrease the effective acoustic volume of one of the speakers.

19 Claims, 10 Drawing Sheets

BALANCED STEREO HEADPHONES WITH UN-BALANCED AIR CHAMBERS

TECHNICAL FIELD

The present application relates generally to headphones, and more particularly, for example, to headphones with enclosures that use mechanical housings as portions of the acoustic chambers and balancing techniques for headphones with different sized free volumes within the mechanical housings.

BACKGROUND

A headphone's acoustic performance depends on the speaker and the acoustic chamber volume. For the same quality speaker, the larger the acoustic chamber volume, the superior the low frequency response that can be achieved. Improved low frequency response results in better audio playback quality and ANC performance. Typically, for a stereo headphone, the left and right speakers have internal cavities of different sizes and shapes due to mechanical design and packaging needs. However, in order to maintain the same acoustic characteristics of the left and right speakers, the acoustic chamber volumes of the left and right stereos are kept at the same despite the differences in available internal volume between the left and right headphones.

SUMMARY

The present disclosure provides systems and methods that improve the performance of headphones and balancing the performance between a matched pair of headphones.

In various embodiments a speaker may be provided. The speaker may include an internal separation wall, a speaker chamber with at least a portion of the speaker chamber defined by the internal separation wall, a speaker disposed within the speaker chamber, a mechanical housing with at least a portion of the mechanical housing also defined by the internal separation wall, and an opening located on the internal separation wall and fluidically connecting the speaker chamber with the mechanical housing.

In various other embodiments, a speaker system may be provided. The speaker system may include a first headphone and a second headphone. The first headphone may include a first internal separation wall, a first speaker chamber with a first chamber volume and defined, at least in part, by the first internal separation wall, a first speaker disposed within the first speaker chamber, a first mechanical housing comprising a first free volume where at least a portion of the first mechanical housing is also defined by the first internal separation wall, and a first opening located on the first internal separation wall and fluidically connecting the first speaker chamber with the first mechanical housing, where a first acoustic volume of the first headphone includes the first chamber volume and the first free volume inside the first mechanical housing. The second headphone may include a second internal separation wall, a second speaker chamber including a second chamber volume and defined, at least in part, by the second internal separation wall, a second speaker disposed within the second speaker chamber, a second mechanical housing including a second free volume, where at least a portion of the second mechanical housing is also defined by the second internal separation wall, and a second opening located on the second internal separation wall and fluidically connecting the second speaker chamber with the second mechanical housing, where a second acoustic volume of the second headphone includes the second chamber volume and the second free volume inside the second mechanical housing.

In certain embodiments, the first free volume in the first mechanical housing and the second free volume in the second mechanical housing are the same volumes. In certain embodiments, the first headphone further includes a component within the first mechanical housing, and the second headphone further includes a different component disposed within the second mechanical housing, thus the first free volume in the first mechanical housing and the second free volume in the second mechanical housing are different.

In various embodiments, the speaker may be an on-ear headphone or over-the-ear headphone.

In certain embodiments, the speaker may further include speaker electronics disposed within the mechanical housing. In certain such embodiments, the speaker system may further include a controller communicatively coupled to the first speaker and the second speaker, and configured to provide first operating instructions to the first speaker and provide second operating instructions to the second speaker. In certain such embodiments, the first operating instructions are different from that of the second operating instructions to substantially equalize outputs of the first speaker and the second speaker.

In certain additional embodiments, the first opening that connects the first speaker chamber and the first free volume in the first mechanical housing and the second opening that connects the second speaker chamber and the second free volume in the second mechanical housing are different sizes and shapes. In certain such embodiments, the first opening and the second opening are designed to substantially equalize acoustic impedances behind the first speaker and the second speaker.

In certain embodiments, the speaker may further include acoustic expansion material disposed within the mechanical housing. In certain such embodiments, acoustic expansion material may be disposed within the first mechanical housing or the second mechanical housing. In certain such embodiments, the acoustic expansion material substantially equalizes acoustic volumes of the first free volume and the second free volume.

In certain embodiments, the speaker may further include a ballast disposed within the mechanical housing. In certain such embodiments, the ballast material may be disposed within the first mechanical housing or the second mechanical housing. In certain such embodiments, the ballast substantially equalizes acoustic volumes of the first free volume and the second free volume.

In various other embodiments, a method may be provided. The method may include determining a first acoustic volume of a first mechanical housing of a first headphone, where the first headphone further comprises a first speaker chamber separated from the first mechanical housing by a first internal separation wall, and where a first opening is located on the first internal separation wall to fluidically connect the first speaker chamber and the first mechanical housing, determining a second acoustic volume of a second mechanical housing of a second headphone, where the second acoustic volume is different from the first acoustic volume, where the second headphone further comprises a second speaker chamber separated from the second mechanical housing by a second internal separation wall, and where a second opening is located on the second internal separation wall to fluidically connect the second speaker chamber and the second mechanical housing, and equalizing outputs of the first speaker and the second speaker based on the first acoustic volume and the second acoustic volume.

The scope of the disclosure is defined by the claims, which are incorporated into this section by reference. A more complete understanding of embodiments of the present disclosure will be afforded to those skilled in the art, as well as a realization of additional advantages thereof, by a consideration of the following detailed description of one or more embodiments. Reference will be made to the appended sheets of drawings that will first be described briefly.

BRIEF DESCRIPTION OF THE DRAWINGS

Aspects of the disclosure and their advantages can be better understood with reference to the following drawings and the detailed description that follows. The included drawings are for illustrative purposes and serve only to provide examples of possible systems and methods for the disclosed methods and systems. These drawings in no way limit any changes in form and detail that may be made to that which is disclosed by one skilled in the art without departing from the spirit and scope of this disclosure.

DETAILED DESCRIPTION

Systems and techniques are described herein for improving acoustic performance of speakers. In one embodiment, the frequency response of headphones may be improved by increasing the effective acoustic chamber volume. For example, such a speaker may include an outside enclosure that contains a speaker chamber and a mechanical housing. The speaker chamber may include a speaker disposed within the speaker chamber. The mechanical housing may include various other hardware of the headphones.

Though the left and right speakers of stereo headphones usually appear to be outwardly symmetrical, the internal cavities of the left and right speakers are often different sizes and shapes for various acoustical and mechanical functioning purposes. Thus, for example, different mechanical components are disposed within the mechanical housings of the left and right speakers. As such, the mechanical housings of the left and right speakers often have different free air volumes (i.e., the volume that is not occupied by components).

To maintain similar acoustic characteristics between the left and right speakers, the left and right speakers typically only utilize the speaker chamber as an acoustic chamber. Thus, in such speakers, the speaker chamber and the mechanical housing are separated by an internal separation wall. Accordingly, air may not flow between the speaker chamber and the mechanical housing and, thus, the speaker chamber and the mechanical housing are not fluidically connected.

In various embodiments of the speakers described herein, an opening may be located on the internal separation wall to fluidically connect the speaker chamber with the mechanical housing. As such, the effective acoustic chamber volume of such speakers may be increased. In certain embodiments, the effective acoustic chamber volume of both the left and right speakers of headphones may be increased in such fashion. Thus, the low frequency performance may be improved.

However, as the free volume of mechanical housings of the left and right speakers may be different, various embodiments of the speakers described include structures and/or techniques to maintain balanced acoustic performance between the left and right speakers of the headphones. Thus, the various embodiments described herein minimize wastage of useful acoustic volumes within speakers while achieving improved and balanced acoustic performance from headphones. Speaker performance may be improved while maintaining similar outside dimensions or, indeed, smaller outside dimensions. Additionally, more affordable speakers or speaker drivers may be used to maintain or improve speaker performance.

Figure 1:
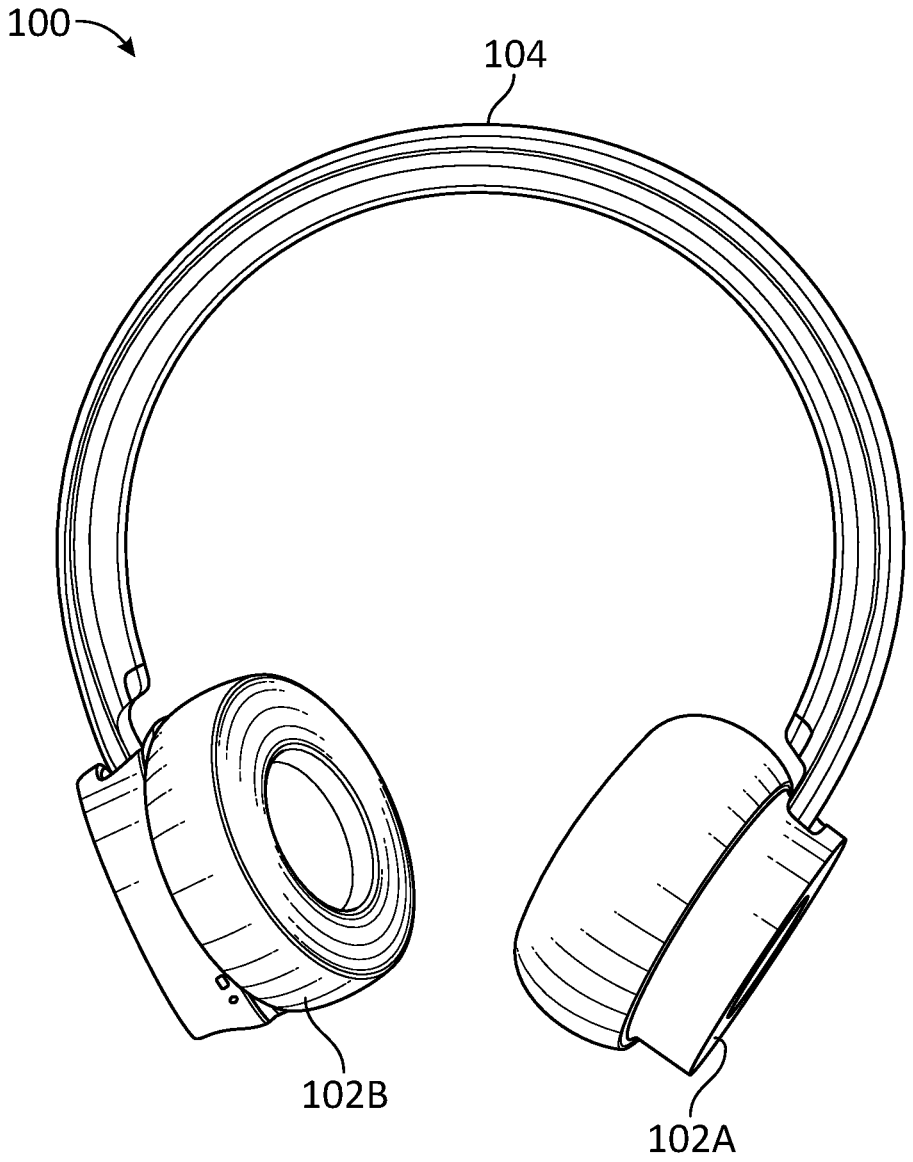
FIG. 1 illustrates a stereo headphone, in accordance with one or more embodiments of the present disclosure.

FIG. 1 illustrates a stereo headphone, in accordance with one or more embodiments of the present disclosure. While FIG. 1 describes an embodiment of a stereo headphone according to an embodiment of the invention, it is appreciated that the systems and techniques described herein may be applicable to any type of speaker (e.g., external speakers, loudspeakers, car mounted speakers, earbuds, as well as other speakers).

FIG. 1 illustrates a headphone system 100 that includes headphones 102A and 102B and headband 104. Headphones 102A and 102B may be on-ear (supra-aural) or over-the-ear (circum-aural) headphones configured to be disposed over the ears of a wearer. Headband 104 may couple headphone 102A to headphone 102B. Certain embodiments of headband 104 may be configured to rest atop the head of a wearer.

Headphone 102A may be a left headphone and headphone 102B may be a right headphone. Headphones 102A and 102B may form a stereo speaker system. For a stereo speaker system, output balance between the various speakers is important. In various other embodiments, such speakers may be any type of speaker (e.g., dynamic speakers, balanced armature speakers, piezo speakers, and the like).

Figure 2:
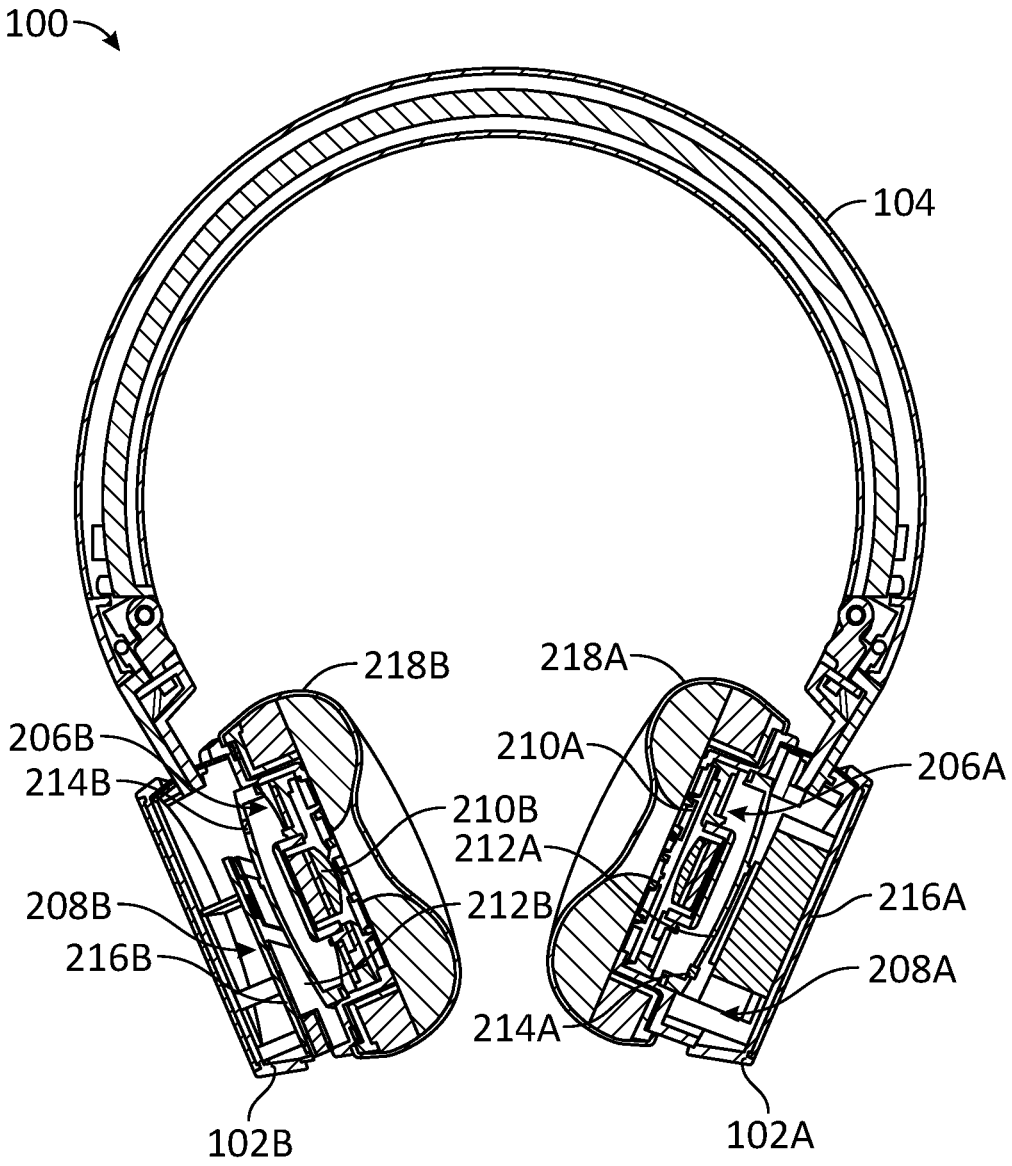
FIG. 2 illustrates a cutaway view of a stereo headphone, in accordance with one or more embodiments of the present disclosure.

FIG. 2 illustrates a cutaway view of a stereo headphone, in accordance with one or more embodiments of the present disclosure. FIG. 2 illustrates a cutaway view of headphone system 100 of FIG. 1 that includes headphones 102A and 102B and headband 104. Headphones 102A and 102B may each include an outer enclosure as shown. The cutaway view of FIG. 2 shows the components of headphones 102A and 102B disposed internally within the outer enclosures.

Headphone 102A includes speaker chamber 206A and mechanical housing 208A.

Speaker chamber 206A may be a first chamber volume. Speaker 210A is disposed within speaker chamber 206A and behind earpad 218A. Earpad 218A may be a soft padding configured to contact a wearer's ears and increase the wearer's comfort while allowing soundwaves produced by speaker 210A to pass through to the wearer's ears.

Mechanical housing 208A may include one or more electrical or mechanical components such as battery 216A. Speaker chamber 206A is separated from mechanical housing 208A by internal separation wall 212A. Internal separation wall 212A may define a "rearward" (e.g., relative to the direction of soundwave output from speaker 210A) portion of speaker chamber 206A and a "forward" portion of mechanical housing 208A. Mechanical housing 208A may, thus, be located "behind" speaker chamber 206A and separated from speaker chamber 206A by internal separation wall 212A.

An opening 214A may be disposed on internal separation wall 212A to fluidically connect speaker chamber 206A with mechanical housing 208A. Thus, air may pass between speaker chamber 206A and mechanical housing 208A, increasing the effective acoustic chamber volume of headphone 102A.

Headphone 102B includes components similar to that described for headphone 102A. Headphone 102B may include speaker chamber 206B of a second chamber volume. In various embodiments, the first chamber volume and the second chamber volume may be the same volume (e.g., to equalize the left and right acoustic characteristics of headphone system 100). One or more electrical or mechanical components such as a printed circuit board (PCB) 216B may be disposed in mechanical housing 208B of headphone 102B. PCB 216B may be a controller configured to control operation of headphone system 100. Thus, mechanical housings 208A and 208B include different components that serve different purposes. For example, battery 216A may be different in volume compared to PCB 216B. Accordingly, the free volumes of mechanical housings 208A and 208B may be different. As such, though the effective acoustic chamber volume of both headphones 102A and 102B are increased due to fluidically connecting the speaker chambers 206A and 206B with mechanical housings 208A and 208B, respectively, the effective acoustic chamber volumes of headphones 102A and 102B may be different. Thus, simply converting mechanical housings 208A and 208B into back acoustic chambers by fluidically coupling mechanical housings 208A and 208B to speaker chambers 206A and 206B, respectively, may lead to unbalanced acoustic performance between headphones 102A and 102B due to differences in the effective acoustic chamber volume.

Figure 3:
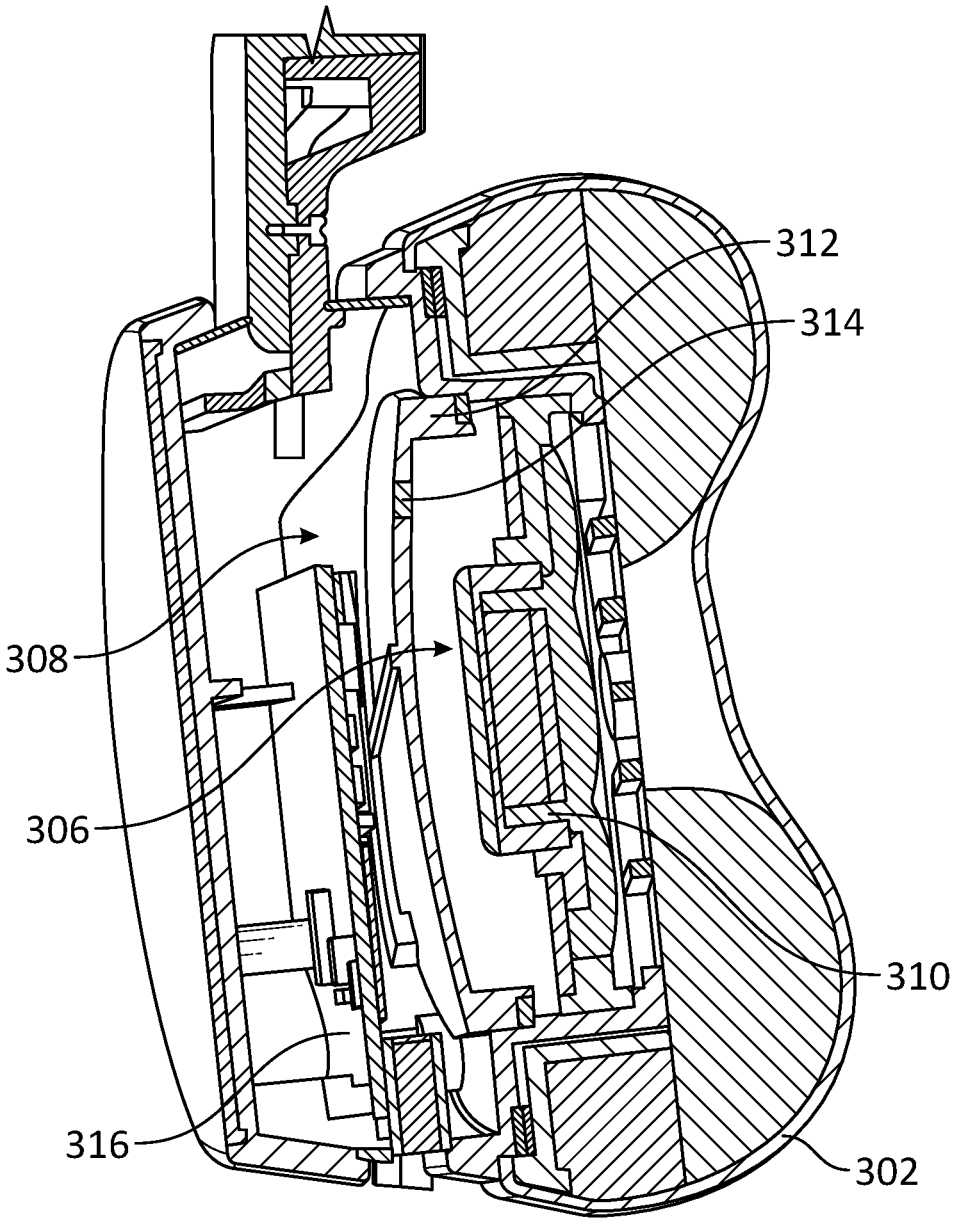
FIG. 3 illustrates a cutaway view of a headphone, in accordance with one or more embodiments of the present disclosure.

FIG. 3 illustrates a cutaway view of a headphone, in accordance with one or more embodiments of the present disclosure. FIG. 3 illustrates a further detailed view of headphone 302 of a headphone system. Headphone 302 includes speaker chamber 306, mechanical housing 308, speaker 310, internal separation wall 312 with opening 314, and component 316. As shown, opening 314 on internal separation wall 312 allows for speaker chamber 306 and mechanical housing 308 to be fluidically connected, increasing the effective acoustic chamber volume.

Figure 4A:
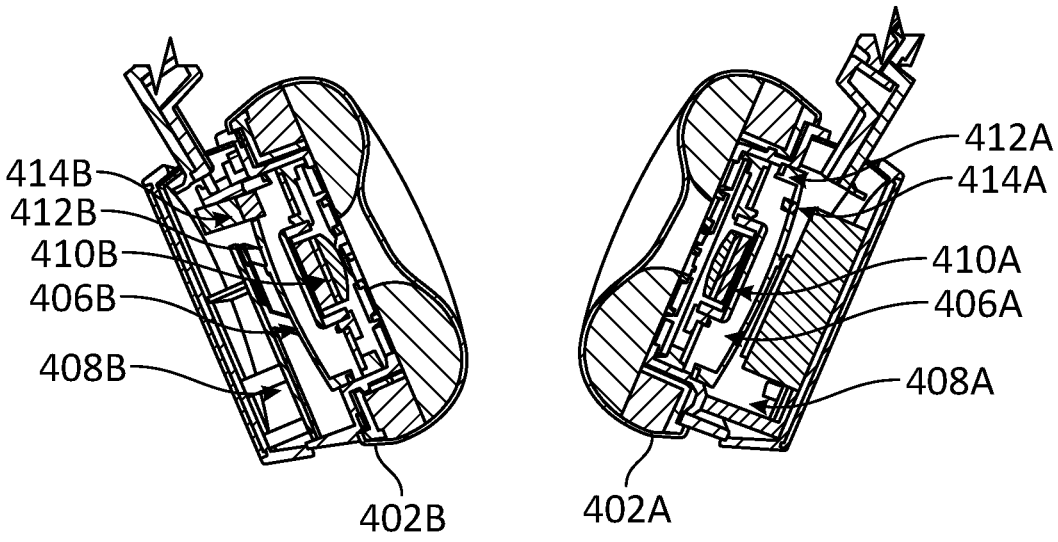
FIG. 4A illustrates a cutaway view of a headphone with equalized left and right performance, in accordance with one or more embodiments of the present disclosure.

FIG. 4A illustrates a cutaway view of a headphone with equalized left and right performance, in accordance with one or more embodiments of the present disclosure. As described herein, in certain embodiments, the effective acoustic chamber volume of the left and right headphones 402A and 402B may be different. FIG. 4A illustrates a technique of tuning the performance of headphones 402A and 402B.

In FIG. 4A, left and right headphones 402A and 402B include different sized openings 414A and 414B (e.g., for example, 414A and 414B may be circular ports of different diameter and length, as well as, possibly, other geometric differences such as different shapes) to connect the respective speaker chambers 406A and 406B with the corresponding mechanical housings 408A and 408B. The different openings 414A and 414B are sized such that the same or substantially the same (e.g., within 20%) acoustic impedances are seen behind the left and right speakers 410A and 410B, respectively, despite the different free volumes of mechanical housings 408A and 408B.

Figure 4B:
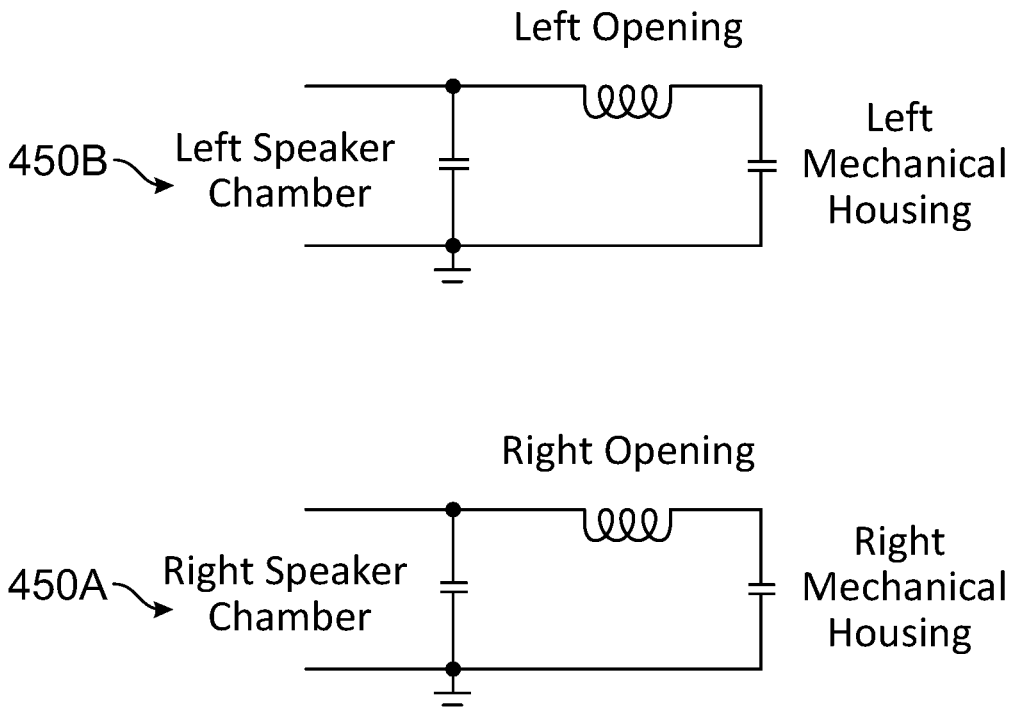
FIG. 4B illustrates a diagram of a representation of a stereo headphone, in accordance with one or more embodiments of the present disclosure.

Tuning to match the acoustic impedances is further shown in FIG. 4B. FIG. 4B illustrates a diagram of an acoustic representation of a stereo headphone, in accordance with one or more embodiments of the present disclosure. FIG. 4B is an acoustic circuit representation of the configuration shown in FIG. 4A. For the configuration of FIG. 4A, acoustic compliances of the left and right speaker chambers 406A and 406B are the same (assuming the left and right speaker chambers 406A and 406B are the same sizes), the left and right openings 414A and 414B's acoustic inductances are different, and the acoustic compliances of mechanical housings 408A and 408B are different, due to the different free volumes within mechanical housings 408A and 408B. Adjusting the size and other geometries of openings 414A and 414B allows for adjustment of the acoustic inductances of each of headphones 402A and 402B. When tuned to the different acoustic compliances of mechanical housings 408A and 408B, the same or substantially the same acoustical impedances can be seen behind speakers 410A and 410B when using different sized openings 414A and 414B, resulting in balanced performance. Such balanced performance is further described in FIG. 9.

Figure 5:
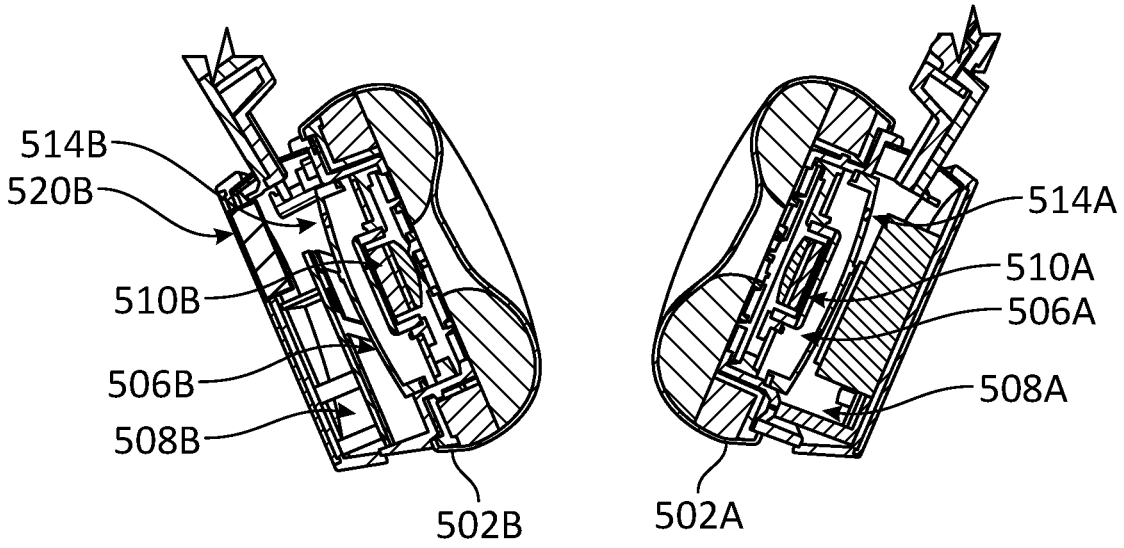
FIG. 5 illustrates a cutaway view of another headphone with equalized left and right performance, in accordance with one or more embodiments of the present disclosure.

FIG. 5 illustrates a cutaway view of another headphone with equalized left and right performance, in accordance with one or more embodiments of the present disclosure. In FIG. 5, the free volume inside the mechanical housing 508A may initially be smaller than the free volume of mechanical housing 508B as the components within mechanical housing 508A takes up a greater volume of space. To equalize or substantially equalize the free volume of mechanical housings 508A and 508B, ballast 520B is added to mechanical housing 508B to balance performance of headphones 502A and 502B. Ballast 520B may be any component that decreases the free volume of mechanical housing 508B. In certain embodiments, ballast 520B may aid in operation of the headphone system of FIG. 5, but in other embodiments, ballast 520B may only equalize the free volumes of headphones 502A and 502B and/or function as weight ballast.

Figure 6:
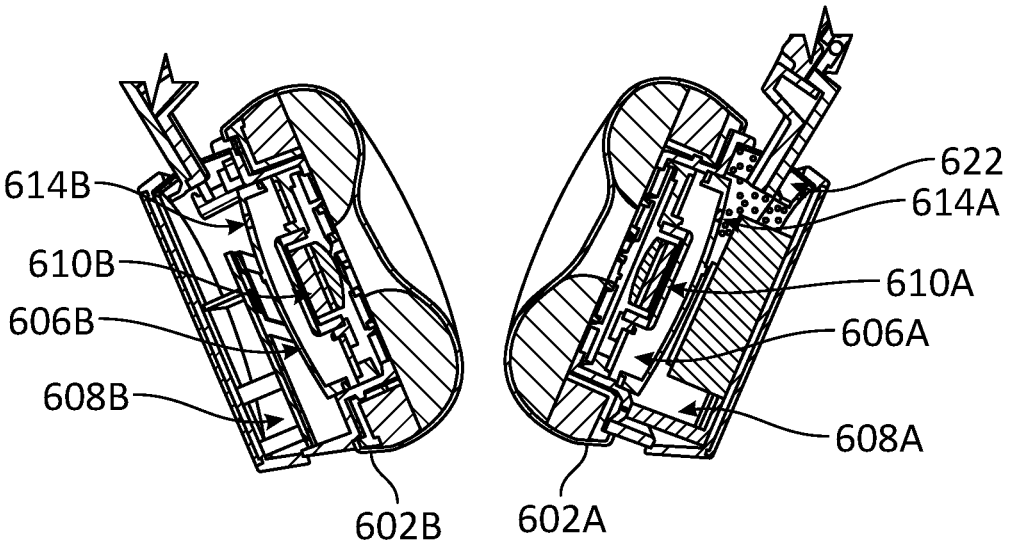
FIG. 6 illustrates a cutaway view of a further headphone with equalized left and right performance, in accordance with one or more embodiments of the present disclosure.

FIG. 6 illustrates a cutaway view of a further headphone with equalized left and right performance, in accordance with one or more embodiments of the present disclosure. In FIG. 6, the free volume inside the mechanical housing 608A may initially be smaller than the free volume inside the mechanical housing 608B. Acoustic expansion material 622 is added to mechanical housing 608A. Acoustic expansion material 622 effectively increases the acoustic volume of mechanical housing 608A. Adding such acoustic expansion material 622 may increase the effective acoustic volume of mechanical housing 608A to be the same or substantially the same as mechanical housing 608B.

Figure 7:
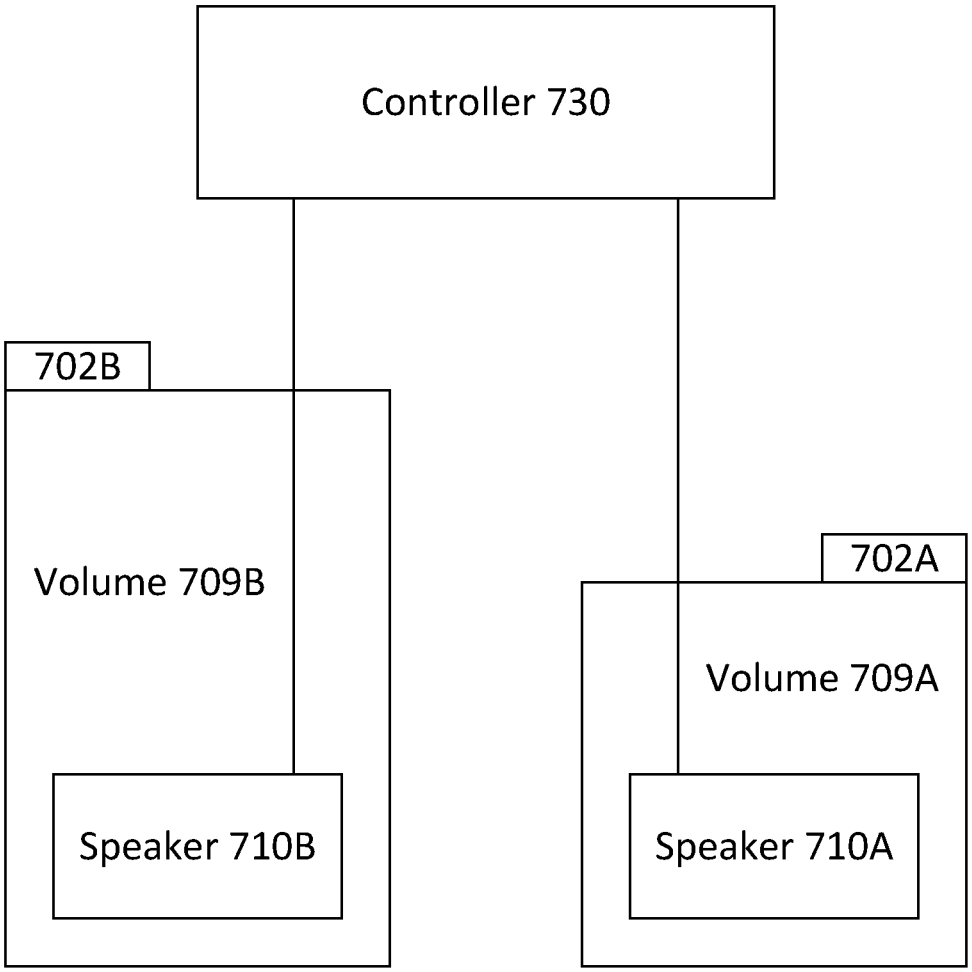
FIG. 7 is a block diagram illustrating a headphone with equalized left and right performance, in accordance with one or more embodiments of the present disclosure.

FIG. 7 is a block diagram illustrating a headphone with equalized left and right performance, in accordance with one or more embodiments of the present disclosure. FIG. 7 illustrates headphones 702A and 702B with speakers 710A and 710B, respectively. The effective acoustic volume 709A of headphone 702A may be smaller than the effective acoustic volume 709B of headphone 702B.

Controller 730 may be communicatively connected (e.g., provide instructions) to and control operation of speakers 710A and 710B. In certain embodiments, controller 730 may include a processor, which can include central processing unit, a micro-controller, a digital signal processor (DSP), or other processing components, for controlling and facilitating operation of speakers 710A and 710B. In some embodiments, controller 730 may further include an analog-to-digital converter that converts the analog audio signals into digital audio signals, or vice versa, and communicates the signals to speakers 710A and 710B.

Controller 730 may include one or more communication channels such as a bus for facilitating communication of data. Controller 730 may additionally include devices for providing device operation and functionality, such as input/output components (e.g., a touch screen, buttons, external data connections, and other components), a memory such as RAM, solid state drive, disk drive, database, etc., and a communications interface. In some embodiments, the communications interface may include a network interface or a wireless transceiver for enabling communication with other devices over a network or other wireless connection.

In order to equalize the performance of headphones 702A and 702B, controller 730 may provide different equalization signals (EQs) to speakers 710A and 710B. Such different EQs may be provided in light of the different effective acoustic volumes 709A and 709B. The different EQs may result from, for example, placement of analog filters within the driver of one or both of speakers 710A and 710B or through different software or hardware implementations of digital speakers. Such digital speakers may, thus, include software that mimics that of analog filters to balance the EQs of speakers 710A and 710B. The EQs may balance or substantially balance the left/right speaker performances of headphones 702A and 702B.

Figure 8:
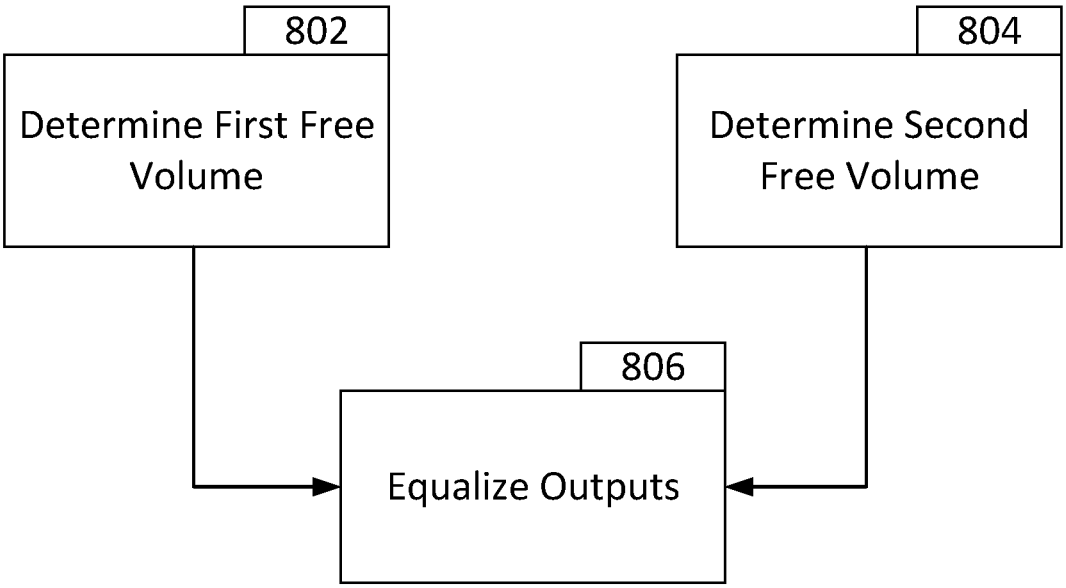
FIG. 8 is a flow chart illustrating an example of tuning left and right headphones, in accordance with one or more embodiments of the present disclosure.

FIG. 8 is a flow chart illustrating an example of tuning left and right headphones, in accordance with one or more embodiments of the present disclosure. In block 802, a first free volume or effective acoustic volume of a first headphone (e.g., a left headphone) is determined. In block 804, a second free volume or effective acoustic volume of a second headphone (e.g., a second headphone) is determined.

Once the effective acoustic volumes of the headphones are determined in blocks 802 and 804, output of the headphones are equalized or substantially equalized in block 806. Thus, in block 806, the controller of the headphone system may be configured to equalize the outputs of the headphones based on the different effective acoustic volumes, different sized openings may be used within the headphones, the free volumes of mechanical housings may be equalized, and/or the acoustic volumes of the headphones may be equalized. As such, acoustic performances of the stereo headphones may be equalized.

Figure 9:
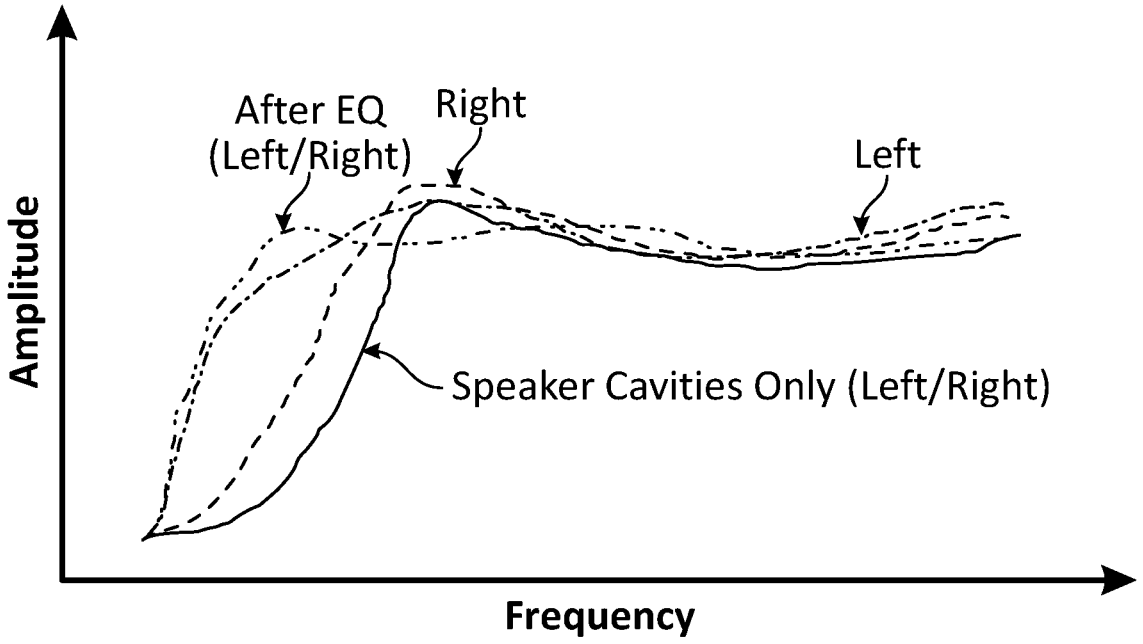
FIG. 9 is a graph illustrating differences in performance after tuning left and right headphones, in accordance with one or more embodiments of the present disclosure.

FIG. 9 is a graph illustrating differences in performance after tuning left and right headphones, in accordance with one or more embodiments of the present disclosure. FIG. 9 illustrates an example of when acoustic performances are equalized between headphones. Though the example shown in FIG. 9 is a result of tuning the EQs of the speakers to equalize the performances of the headphones, results similar to that of FIG. 9 may be achieved through any of the other techniques described herein. FIG. 9 illustrates outputs of speakers at various frequencies.

FIG. 9 illustrates the performance of four different versions of headphones. The "speaker cavities only" headphone is a headphone with only the speaker chamber used as an acoustic chamber. As shown, such a configuration results in poor low frequency performance.

The "left" and "right" headphones are headphones with mechanical housings also used as part of the acoustic chamber. Though the low frequency performance of both the "left" and the "right" headphones are improved, the "right" headphone includes a much smaller free volume within the mechanical housing and, thus, the performance of the headphones are unmatched.

The "After EQ" headphone is a headphone system with the left and right EQs tuned to equalize performance between the headphones. As shown, after EQ tuning, the left and right outputs are tuned to be the same while the low frequency response is superior to the headphone with only the speaker chamber used as an acoustic chamber. Thus, improved and balanced low frequency performance is achieved between the left and the right headphones.

Where applicable, various embodiments provided by the present disclosure may be implemented using hardware, software, or combinations of hardware and software. Also, where applicable, the various hardware components and/or software components set forth herein may be combined into composite components comprising software, hardware, and/or both without departing from the spirit of the present disclosure. Where applicable, the various hardware components and/or software components set forth herein may be separated into sub-components comprising software, hardware, or both without departing from the scope of the present disclosure. In addition, where applicable, it is contemplated that software components may be implemented as hardware components and vice-versa.

Software, in accordance with the present disclosure, such as program code and/or data, may be stored on one or more computer readable mediums. It is also contemplated that software identified herein may be implemented using one or more general purpose or specific purpose computers and/or computer systems, networked and/or otherwise. Where applicable, the ordering of various steps described herein may be changed, combined into composite steps, and/or separated into sub-steps to provide features described herein.

The foregoing disclosure is not intended to limit the present disclosure to the precise forms or particular fields of use disclosed. As such, it is contemplated that various alternate embodiments and/or modifications to the present disclosure, whether explicitly described or implied herein, are possible in light of the disclosure. Having thus described embodiments of the present disclosure, persons of ordinary skill in the art will recognize that changes may be made in form and detail without departing from the scope of the present disclosure. Thus, the present disclosure is limited only by the claims.

What is claimed is:

1. A speaker system comprising:

a first speaker housing and a second speaker housing, each comprising an internal separation wall;

a speaker chamber, wherein at least a portion of the speaker chamber is defined by the internal separation wall;

a speaker disposed within the speaker chamber;

a mechanical housing, wherein at least a portion of the mechanical housing is also defined by the internal separation wall; and an opening located on the internal separation wall and fluidically connecting the speaker chamber with the mechanical housing;

wherein the first speaker housing has a first free volume and the second speaker housing has a second free volume that is different from the first free volume; and a controller configured to equalize an output of the speaker from the first speaker housing with the output of the speaker from the second speaker housing.

2. The speaker of claim 1, further comprising speaker electronics disposed within the mechanical housing.

3. The speaker of claim 1, further comprising acoustic expansion material disposed within the mechanical housing.

4. The speaker of claim 1, further comprising a ballast disposed within the mechanical housing.

5. The speaker of claim 1, wherein the speaker is an on-ear or over-the-ear headphone.

6. A speaker system comprising:

a first headphone comprising:

a first internal separation wall;

a first speaker chamber comprising a first chamber volume and defined, at least in part, by the first internal separation wall;

a first speaker disposed within the first speaker chamber;

a first mechanical housing comprising a first free volume, wherein at least a portion of the first mechanical housing is also defined by the first internal separation wall; and a first opening located on the first internal separation wall and fluidically connecting the first speaker chamber with the first mechanical housing, wherein a effective first acoustic volume of the first headphone comprises the first free volume and the first chamber volume; and a second headphone comprising:

a second internal separation wall;

a second speaker chamber comprising a second chamber volume and defined, at least in part, by the second internal separation wall;

a second speaker disposed within the second speaker chamber;

a second mechanical housing comprising a second free volume, wherein at least a portion of the second mechanical housing is also defined by the second internal separation wall; and a second opening located on the second internal separation wall and fluidically connecting the second speaker chamber with the second mechanical housing, wherein a effective second acoustic volume of the second headphone comprises the second free volume and the second chamber volume;

wherein the first effective acoustic volume and the second effective acoustic volume are equalized to be substantially the same acoustic volumes.

7. The speaker system of claim 6, wherein the first headphone further comprises a first component disposed within the first mechanical housing, and wherein the second headphone further comprises a second component disposed within the second mechanical housing.

8. The speaker system of claim 7, wherein the first free volume of the first mechanical housing and the second free volume of the second mechanical housing are different.

9. The speaker system of claim 8, wherein a ballast is disposed within the larger of the first mechanical housing and the second mechanical housing to substantially equalize the first and second effective acoustic volumes.

10. The speaker system of claim 8, wherein an acoustic expansion material is disposed within the smaller mechanical housing between the first mechanical housing and the second mechanical housing to substantially equalize the first and second effective acoustic volumes.

11. The speaker system of claim 6, wherein the first effective acoustic volume and the second effective acoustic volume are different volumes.

12. The speaker system of claim 11, further comprising a controller communicatively coupled to the first speaker and the second speaker and configured to provide first operating instructions to the first speaker and provide second operating instructions to the second speaker.

13. The speaker system of claim 12, wherein the first operating instructions are different from that of the second operating instructions to substantially equalize outputs of the first speaker and the second speaker.

14. The speaker system of claim 11, wherein the first opening and the second opening are different sizes that are sized to substantially equalize acoustic impedances behind the first speaker and the second speaker.

15. A method comprising:

determining a first free volume of a first mechanical housing of a first headphone, wherein the first headphone further comprises a first speaker chamber separated from the first mechanical housing by a first internal separation wall, and wherein a first opening is located on the first internal separation wall to fluidically connect the first speaker chamber and the first mechanical housing;

determining a second free volume of a second mechanical housing of a second headphone, wherein the second free volume is different from the first free volume, wherein the second headphone further comprises a second speaker chamber separated from the second mechanical housing by a second internal separation wall, and wherein a second opening is located on the second internal separation wall to fluidically connect the second speaker chamber and the second mechanical housing; and equalizing outputs of the first speaker and the second speaker based on the first free volume and the second free volume.

16. The method of claim 15, wherein the equalizing the outputs comprises:

configuring a controller to provide first operating instructions to the first speaker and second operating instructions to the second speaker, wherein the first operating instructions are different from that of the second operating instructions to substantially equalize the outputs of the first speaker and the second speaker.

17. The method of claim 15, wherein the equalizing the outputs comprises sizing the first opening and the second opening to substantially equalize acoustic impedances behind the first speaker and the second speaker.

18. The method of claim 15, wherein the equalizing the outputs comprises disposing a ballast within a larger of the first mechanical housing and the second mechanical housing to substantially equalize the first and second free volumes.

19. The method of claim 15, wherein the equalizing the outputs comprises disposing acoustic expansion material disposed within a smaller of the first mechanical housing or the second mechanical housing to substantially equalize acoustic volumes of the first and second free volumes.

* * * * *